US006540320B2

(12) United States Patent
Ng

(10) Patent No.: US 6,540,320 B2
(45) **Date of Patent: *Apr. 1, 2003**

(54) LOW-HEIGHT INK JET SERVICE STATION

(75) Inventor: Keng Leong Ng, Singapore (SG)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/477,860

(22) Filed: Jan. 5, 2000

(65) Prior Publication Data

US 2002/0003553 A1 Jan. 10, 2002

(51) Int. Cl.[7] ..... B41J 2/165

(52) U.S. Cl. ..... 347/22; 347/29; 347/32

(58) Field of Search ..... 347/22, 32, 29, 347/33

(56) References Cited

U.S. PATENT DOCUMENTS

| | | | | | |
|---|---|---|---|---|---|
| 5,841,450 | A | * | 11/1998 | Kawamura | 347/32 |
| 5,971,520 | A | * | 10/1999 | Nakahara | 347/30 |
| 6,027,212 | A | * | 2/2000 | Tanno et al. | 347/108 |
| 6,132,027 | A | * | 10/2000 | Suzuki et al. | 347/33 |
| 6,371,595 | B1 | * | 4/2002 | Takemoto et al. | 347/33 |

FOREIGN PATENT DOCUMENTS

| | | | | |
|---|---|---|---|---|
| JP | 2-45156 | * | 2/1990 | 347/32 |
| JP | 6-262768 A | * | 9/1994 | B41J/2/165 |

* cited by examiner

*Primary Examiner*—Shih-wen Hsieh

(57) ABSTRACT

A system and a method for servicing a printhead using a low-height service station design. The system of the present invention includes a low-height service station having a gear and clutch arrangement that permits a service station drive assembly and a print media feed assembly to use the same motor. By momentarily reversing the motor, the gear and clutch arrangement permits the service station drive assembly to be engaged and the print media feed assembly to be disengaged, or vice versa. Moreover, the gear and clutch arrangement provides a means for a capping platform and a wiping platform within the service station to move independently of each other.

19 Claims, 13 Drawing Sheets

LOW-HEIGHT INK JET SERVICE STATION

CROSS REFERENCE TO RELATED APPLICATIONS

This application is related to the following copending utility patent applications, each filed concurrently on Jan. 5, 2000: Ser. No. 09/477,645 by Ram Santhanam et al., entitled "Vent For An Ink-Jet Print Cartridge", Ser. No. 091477,646 by Ram Santhanam et al., entitled "Ink-Jet Print Cartridge Having A Low Profile", Ser. No.: 09/477,644 by Junji Yamamoto et al., entitled "Horizontally Loadable Carriage For An Ink-Jet Printer", Ser. No.: 09/477,649 by Junji Yamamoto et al., entitled "Method And Apparatus For Horizontally Loading And Unloading An Ink-Jet Print Cartridge From A Carriage", Ser. No.: 09/478,148 by Richard A. Becker et al., entitled "Techniques For Providing Ink-Jet Cartridges With A Universal Body Structure", Ser. No.: 09/477,843 by Ram Santhanam et al., entitled "Techniques For Adapting A Small Form Factor Ink-Jet Cartridge For Use In A Carriage Sized For A Large Form Factor Cartridge", Ser. No.: 09/478,190 by James M. Osmus, "Printer With A Two Roller, Two Motor Paper Delivery System", Ser. No.: 09/477,648 by Matt Shepherd et al., entitled "New Method Of Propelling An Inkjet Printer Carriage", Ser. No.: 29/116,564 by Ram Santhanam et al., entitled "Ink Jet Print Cartridge", and Ser. No.: 09/477,940 by Ram Santhanam et al., entitled "Multiple Bit Matrix Configuration For Key-Latched Printheads", all of which are incorporated by reference.

BACKGROUND OF THE INVENTION

1. Field of the Invention

The present invention relates in general to ink jet and other types of printers and more particularly to a system and a method using a low-height service station design for servicing a printhead.

2. Related Art

Digital set-top boxes (e.g., cable television boxes, Internet terminal boxes etc.) are being used increasingly with consumer home entertainment equipment such as television sets, video cassette recorders, digital video disc (DVD) players and the like. In many cases, it may be desirable for users to obtain a hard copy of information displayed on the screen of their television sets. Specifically, users typically want to print e-mail messages, maps, recipes and information-rich content, such as still or captured scenes from live broadcasts, DVD players, movie cameras, video recorders etc.

Currently, if a user wants to have a hardcopy of the displayed information, the user has to use a conventional printer. Most conventional printers, however, are bulky, and thus require large amounts of space in users' home entertainment units. Hence, a printer specifically designed for use in home entertainment units is needed (i.e., a living room printer).

The living room printer should be of low height (i.e., low profile) and relatively narrow in width to blend in with other home entertainment equipment. In addition, since home entertainment equipment is usually stacked one atop another in home entertainment units, user access to the living room printer should preferably be through a front plane of the printer.

Designing a low profile, narrow width printer with user front plane access can present some technical difficulties with printers. For example, for ink jet printers, one common problem is that the ink nozzles of the ink jet printer frequently become plugged or otherwise contaminated with a variety of contaminants. For example, contaminants such as dried ink and foreign matter (such as paper fibers) can crust the nozzle both externally and internally. This can prevent the nozzles from operating properly and lower the quality of print. As a result, ink jet printers typically include a service station that services a printhead to keep the nozzles operating properly.

A typical function of the service station is called capping, which prevents the printhead from drying out when not in use. Capping uses a cap to provide a seal between the vaporization chamber and the printhead. Capping prevents ink from being drawn by capillary action from within the ink supply through the printhead. Another function of the service station is known as wiping, which uses a wiping action to remove external debris and contaminants from the nozzles. Ink used in ink jet printers is designed to dry quickly and permanently and, if allowed to dry on the nozzles and not wiped away, becomes difficult to remove.

Ink jet printer service stations may be implemented in a plurality of designs. For instance, one type of service station is a passive service station that does not use a motor. Passive service stations, however, are noisy and not very effective, which can lower print quality and shorten printhead life. Another type of service station design uses a motor to operate the service station and a separate motor to feed paper through the printer. There are several problems, however, with using a motor to feed the paper and a motor to operate the service station, including that the printer is more costly, complex and heavier (and thereby less portable) due to an additional motor and accompanying material.

Service stations are typically designed so that a platform that performs capping (a capping platform) and a platform that performs wiping (a wiping platform) are in close proximity, lie in the same plane and move together in that plane. This can cause ink to be dripped and splattered from the wipers onto the capping platform during the wiping action, thereby decreasing the effectiveness of the service station. In addition, service station designs generally are not greatly concerned with height constraints because the height of the printer, which generally is determined by the paper path, is more than enough to accommodate the service station. A printer having a lower height is desirable, however, because such a printer would easily fit into shelves and spaces used for other electronic equipment (such as VCRs and stereo equipment). Such a low-height printer would require a service station that is low-height, effective and efficient.

Therefore, what is needed is an ink jet printer having a low height that uses a single motor both to feed the paper through the printer and to operate the service station. What is also needed is a printer that includes capping and wiping platforms that do not operate in the same plane and move independently of each other to minimize the likelihood of ink residue from the wiping action contaminating the caps. Whatever the merits of the above-mentioned systems and methods, they do not achieve the benefits of the present invention.

SUMMARY OF THE INVENTION

To overcome the limitations in the prior art as described above, and to overcome other limitations that will become apparent upon reading and understanding the present specification, the present invention is embodied in a system and a method that uses a low-height service station design to service a printhead. The present invention uses a unique design to permit a single motor both to feed a print media through the printer and to operate the service station. Unlike other service station designs, the service station of the present invention includes a low-height profile, which enables the service station to be used with printers having a small vertical profile, and an independent lifting action for wiping and capping platforms, which prevents splattering of ink onto the caps during wiping operations. The present invention provides inexpensive, effective and simple servicing of a printhead.

The low-height service station design of the present invention includes a gear and clutch arrangement that permits a service station drive assembly and a print media feed assembly to use the same motor. Moreover, the gear and clutch arrangement provides a means for a capping platform and a wiping platform to move independently of each other. The capping platform includes a cap that is used in capping a printhead assembly and the wiping platform includes a wiper that is used to wipe the printhead assembly. Independent movement prevents the wiping platform from splattering ink onto the capping platform during wiping operations.

The present invention also embodied in a method for using a single motor to service a printhead assembly and feed a print media through a printer. The method includes disengaging an engaged print media feed assembly from the motor by momentarily reversing the direction of the motor, engaging a service station drive assembly, turning the motor in the forward direction so as to perform service station operations. The method also includes disengaging the service station drive assembly and engaging the print media feed assembly by momentarily reversing the motor direction. In a preferred embodiment, engagement of the motor is achieved using a clutch. Moreover, precise positioning of a capping platform and a wiping platform is achieved using a camshaft having a plurality of cams.

Other aspects and advantages of the present invention as well as a more complete understanding thereof will become apparent from the following detailed description, taken in conjunction with the accompanying drawings, illustrating by way of example the principles of the invention. Moreover, it is intended that the scope of the invention be limited by the claims and not by the preceding summary or the following detailed description.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the present invention.

Referring now to the drawings in which like reference numbers represent corresponding parts throughout.

DETAILED DESCRIPTION OF THE PREFERRED EMBODIMENTS

In the following description of the invention, reference is made to the accompanying drawings, which form a part thereof, and in which is shown by way of illustration a specific example whereby the invention may be practiced. It is to be understood that other embodiments may be utilized and structural changes may be made without departing from the scope of the present invention.

I. Introduction

Low-height printers are desirable because may be easily placed in a number of locations around the home. For example, a low-height printer will not only fit onto a desktop but also into smaller and more confined spaces that are used to hold other electronic equipment. A low-height printer, however, requires a low-height service station. The present invention uses a gear and clutch arrangement to provide a low-height service station that is effective and efficient. Moreover, the present invention permits the capping and wiping platforms of the service station to move independently of each other to prevent ink contamination during wiping operations. The present invention also uses a single motor to operate both the service station and a print media feed assembly that transports print media to a printhead assembly.

II. General Overview

Figure 1:
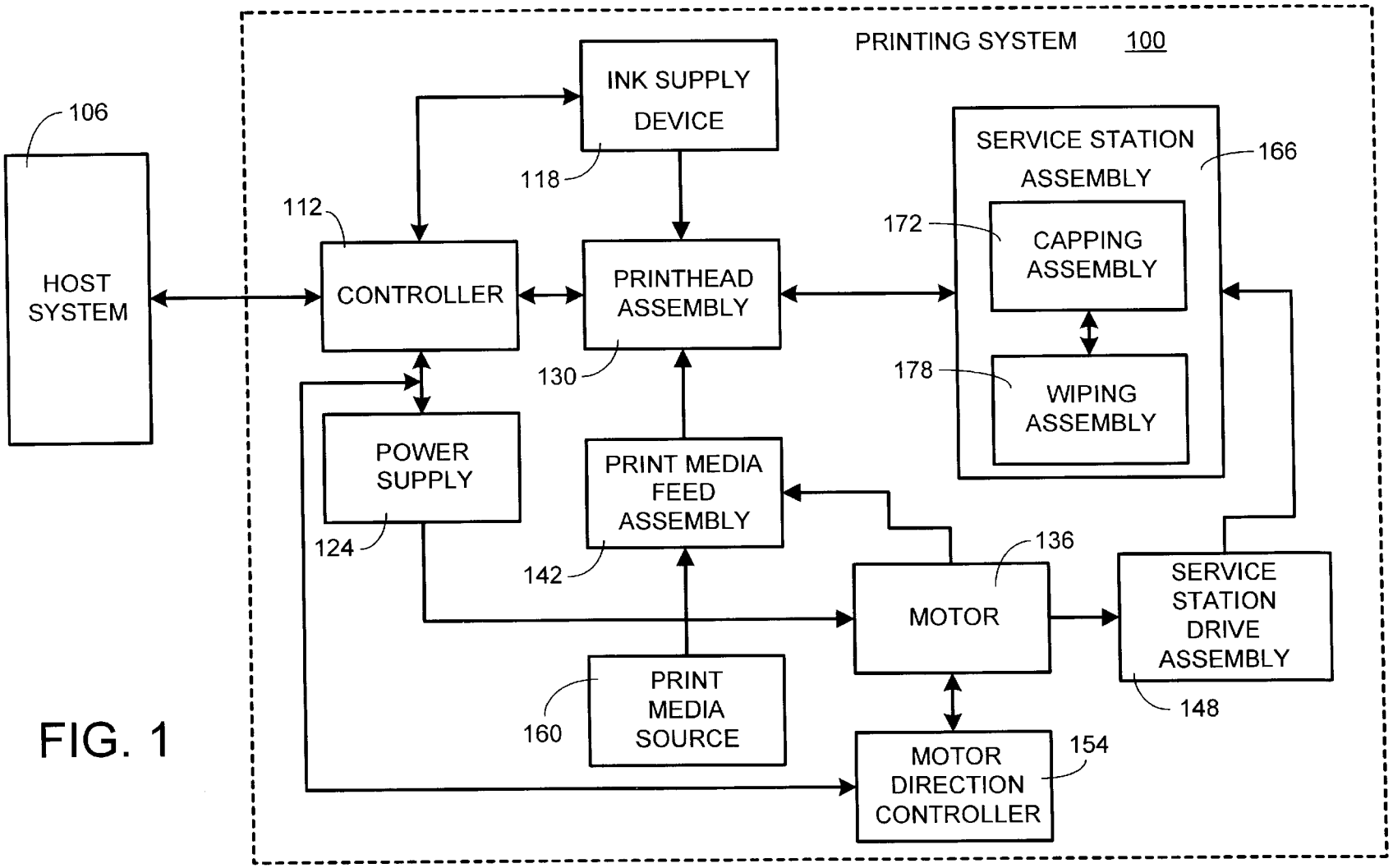
FIG. 1 is an overall block diagram of overall printing system incorporating the present invention.

FIG. 1 is an overall block diagram of overall printing system incorporating the present invention. In general, the printing system 100 can be used for printing a material (such as ink) onto a print media, which can be paper. The printing system 100 is electronically coupled to a host system 106, which can be a computer or microprocessor for producing print data for the printing system 100 to print.

The printing system 100 includes a controller 112 coupled to an ink supply device 118, a power supply 124 and a printhead assembly 130. The printhead assembly 130 generally includes a printhead (not shown) and a carriage assembly (not shown) that allows the printhead to traverse across the print media. The ink supply device 118 is fluidically coupled to the printhead assembly 130. A motor 136, which receives power from the power supply 124, is coupled to a print media feed assembly 142 and a service station drive assembly 148. Although only one motor 136 is shown, the printing system 100 may include a plurality of other motors that perform various other functions (such as a paper pick-up motor to pick-up paper from a paper storage tray). The direction of the motor 136 is controlled by a motor direction controller 154 that is coupled to the controller 112. A print media source 160 supplies a print media (not shown) to the print media feed assembly 142. A service station assembly 166, which includes a capping assembly 172 and a wiping assembly 178, is coupled to the service station drive assembly 148 and interacts with the printhead assembly 130.

During operation of the printing system 100, the power supply 124 provides a controlled voltage to the controller 112 and the motor 136. The controller 112 receives the print data from the host system 106 and processes the print data into printer control information and image data. The processed data, image data and other static and dynamically generated data are exchanged with the ink supply device 118 and the printhead assembly 130 for controlling the printing system 100.

The printhead assembly 130 receives ink from the ink supply device 118 and prints by ejecting the ink through the printhead assembly 130 onto a print media (such as paper). The print media is supplied by the print media source 160 and transported to the printhead assembly 130 at least in part by the print media feed assembly 142. The motor 136 drives the print media feed assembly 142 and provides a means to transport the print media from the print media source 160 to the printhead assembly 130. The motor 136 also drives the service station drive assembly 148, which provides control of the service station assembly 166 including the capping assembly 172 and the wiping assembly 178. Generally, when the service station drive assembly 148 is engaged with the motor 136, the capping assembly 172 and wiping assembly 178 are active and the service station drive assembly 148 provides precise positioning control to allow the printhead assembly 130 to be capped and wiped. The engagement and disengagement of the motor 136 with the print feed media assembly 142 and the service station drive assembly 148 is achieved in part using the motor direction controller 154.

For example, if the printing system 100 is performing a print media feed operation and the printhead assembly 130 needs service station operations performed, the motor direction controller 154 disengages the print media feed assembly 142 and engages the service station drive assembly 148 by momentarily reversing the direction of the motor 136 (generally less than one full revolution). Similarly, after the service station operations have been performed the motor direction controller 154 disengages the service station drive assembly 148 and engages the print media feed assembly 142 by again momentarily reversing the direction of the motor 136. Thus, the motor 136 is used both to transport the print media to the printhead assembly 130 and to operate the service station assembly 166 while precisely controlling the positioning of the capping assembly 172 and the wiping assembly 178 relative to the printhead assembly 130. The motor 136 can be used to perform both of these tasks because in general the print media will not be advanced in the printing system 100 while the printhead assembly 130 is being serviced by the service station assembly 166.

III. Structural Overview

Figure 2:
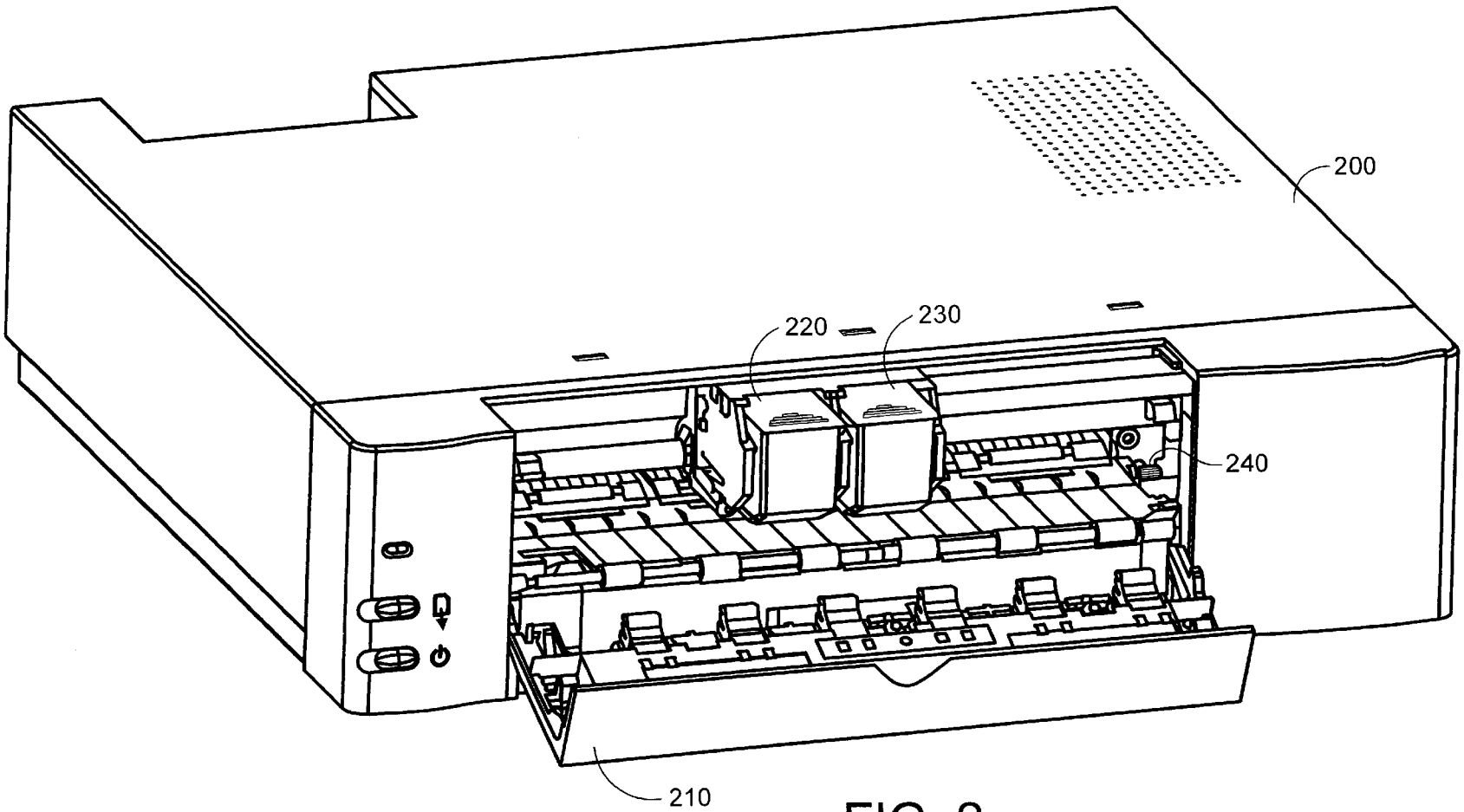
FIG. 2 is an exemplary printing device that incorporates the present invention and is shown for illustrative purposes only.

FIG. 2 is an exemplary printing device that incorporates the present invention and is shown for illustrative purposes only. Generally, a printing device 200 includes a door 210 covering an opening of the printing device 200. A first print cartridge 220 and a second print cartridge 230 are designed to install within the printing device 200. Both of the print cartridges 220, 230 are mounted on a carriage assembly (not shown) that provides linear horizontal movement across a print media.

A service station, which is not shown in FIG. 2, attaches at an attachment point 240 at the side of the opening. The service station may be attached using a variety of techniques, such as a spur gear. When the service station is attached to the printing device 200 at the attachment point 240, the service station is able to provide service station operations to the first print cartridge 220 and the second print cartridge 230.

Figure 3A:
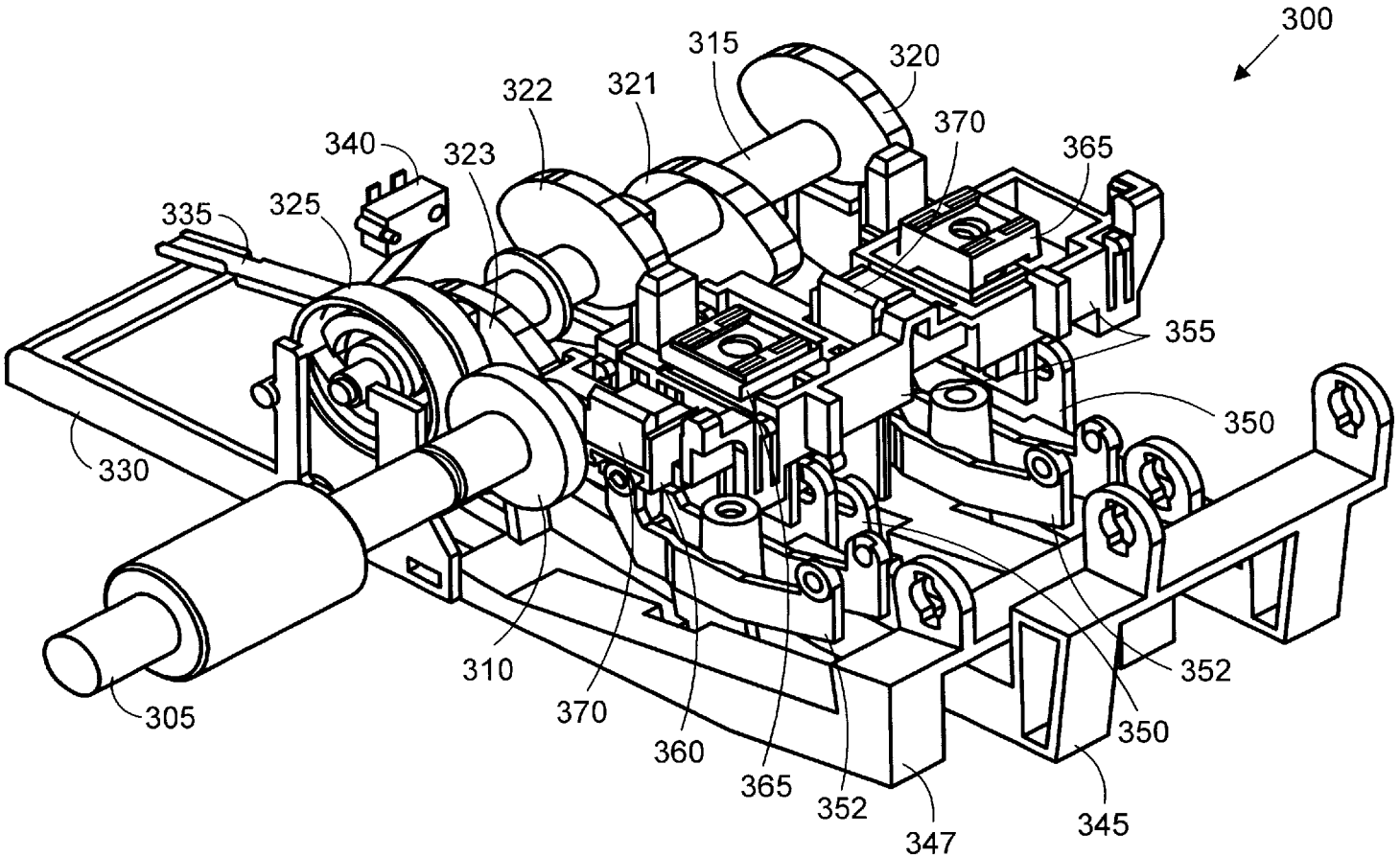
FIG. 3A is a perspective view of a preferred embodiment of the present invention.

FIG. 3A is a perspective view of a preferred embodiment of the present invention. A service station drive assembly 300 (which is a preferred embodiment of the service station drive assembly 148 of FIG. 1) includes a paper feed shaft 305 having a line feed gear 310 at one end. A camshaft 315, having a plurality of cams including a first cam 320, a second cam 321, a third cam 322 and a fourth cam 323, has a clutch 325 at one end. The camshaft 315 goes through each of the cams 320, 321, 322, 323 and is offset from the center of each cam 320, 321, 322, 323. In this preferred embodiment, the use of the camshaft 315 is preferred because of space considerations. In particular, the camshaft 315 occupies a small amount of space in the vertical direction (providing a low height for the service station) while still achieving the timing requirements needed to precisely position the service station.

A rotating assembly (or an "F" assembly) 330 is attached to one side of the clutch 325 and is coupled to an arm 335 that, as discussed below, activates a position sensor 340. The cams 320, 321, 322, 323 activate a series of lifting arms that in turn activate a series of rocker arms. In particular, a capping lifting arm 345 operates a capping rocker arm 350 whereby is mounted on one end capping platforms 355. Similarly, a wiping lifting arm 347 operates a wiping rocker arm 352 whereby is mounted on one end wiping platforms 360. Each of the capping platforms 355 contains a cap 365 while each of the wiping platforms 360 contains a wiper 370.

Figure 3B:
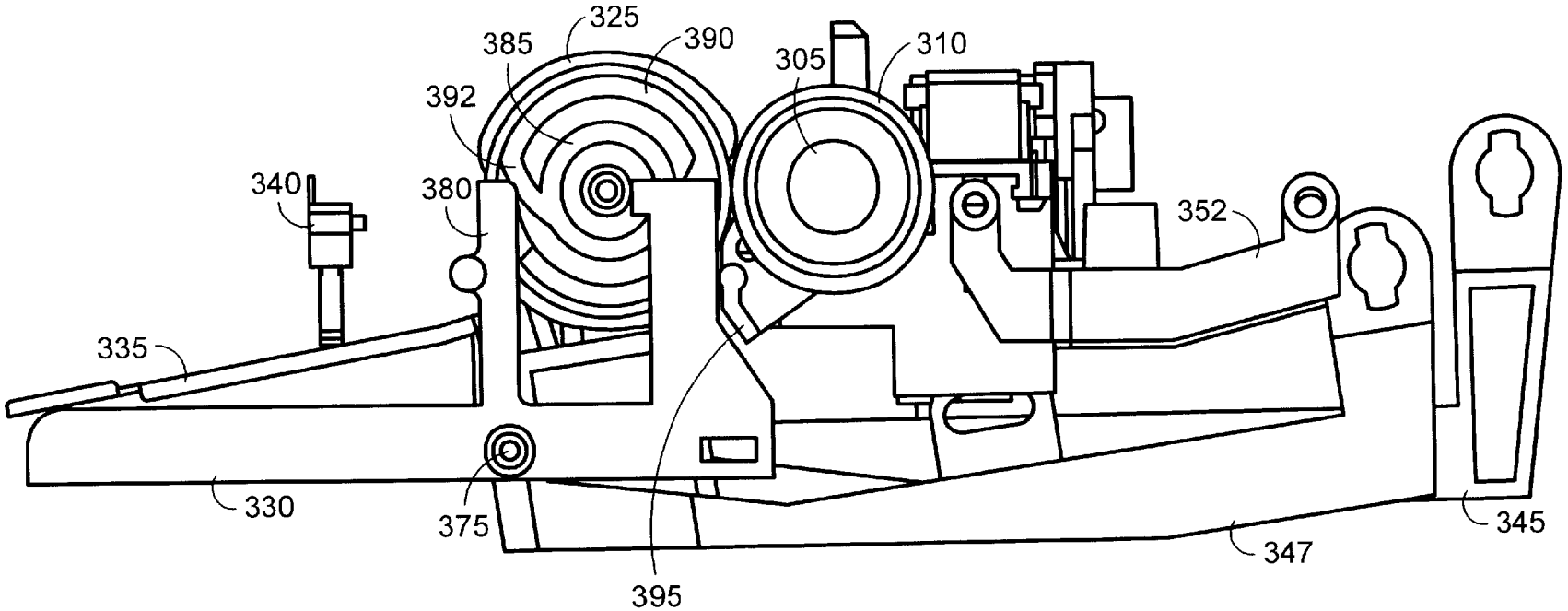
FIG. 3B is an elevation view of a preferred embodiment of the present invention shown in FIG. 3A.

FIG. 3B is an elevation view of a preferred embodiment of the present invention shown in FIG. 3A. The "F" assembly 330 includes a pivot point 375 about which the "F" assembly 330 is able to rotate. The "F" assembly 330 includes a pin (not shown) on the opposite side near the top of a first arm 380 of the "F" assembly 330. The pin rides in one of two tracks that are molded into the clutch 325. An inner track 385 is a smaller track molded into the clutch 325 and an outer track 390 is a larger diameter track molded into the clutch 325. The inner track 385 and outer track 390 are connected by a connecting track 392 that provide a means for the pin to travel between the two tracks 385, 390.

The pin travels along either the inner track 385 or the outer track 390 depending on whether a print media feed or a service station operation is being performed. Further, when the motor is reversed momentarily (for example, a quarter turn), the pin travels from one track to the other via the connecting track 392. In this preferred embodiment, when the printing device 300 is performing a print media feed operation the pin is located within the inner track 385. When the printing device 300 is performing a service station operation, the pin in located in the outer track 390. As discussed in detail below, the "F" assembly 330 rotates about the pivot point 375 depending upon which track the pin is located.

A lever arm 395, which is connected to a series of gears on the capping platforms 355 and the wiping platforms 360, rotates depending on the position of the "F" assembly 330. The lever arm 395 will engage or disengage a gear train on the platforms 355, 360. In other words, the position of the lever arm 395 indicates whether the service station drive assembly 300 is engaged or disengaged. For example, in FIG. 3B, the lever arm 395 is moved away from the "F" assembly and the service station drive assembly 300 is engaged with the motor. Conversely, when the lever arm 395 overlies the first arm 380 the service station drive assembly 300 is disengaged from the motor.

IV. Operational Overview

Figure 4:
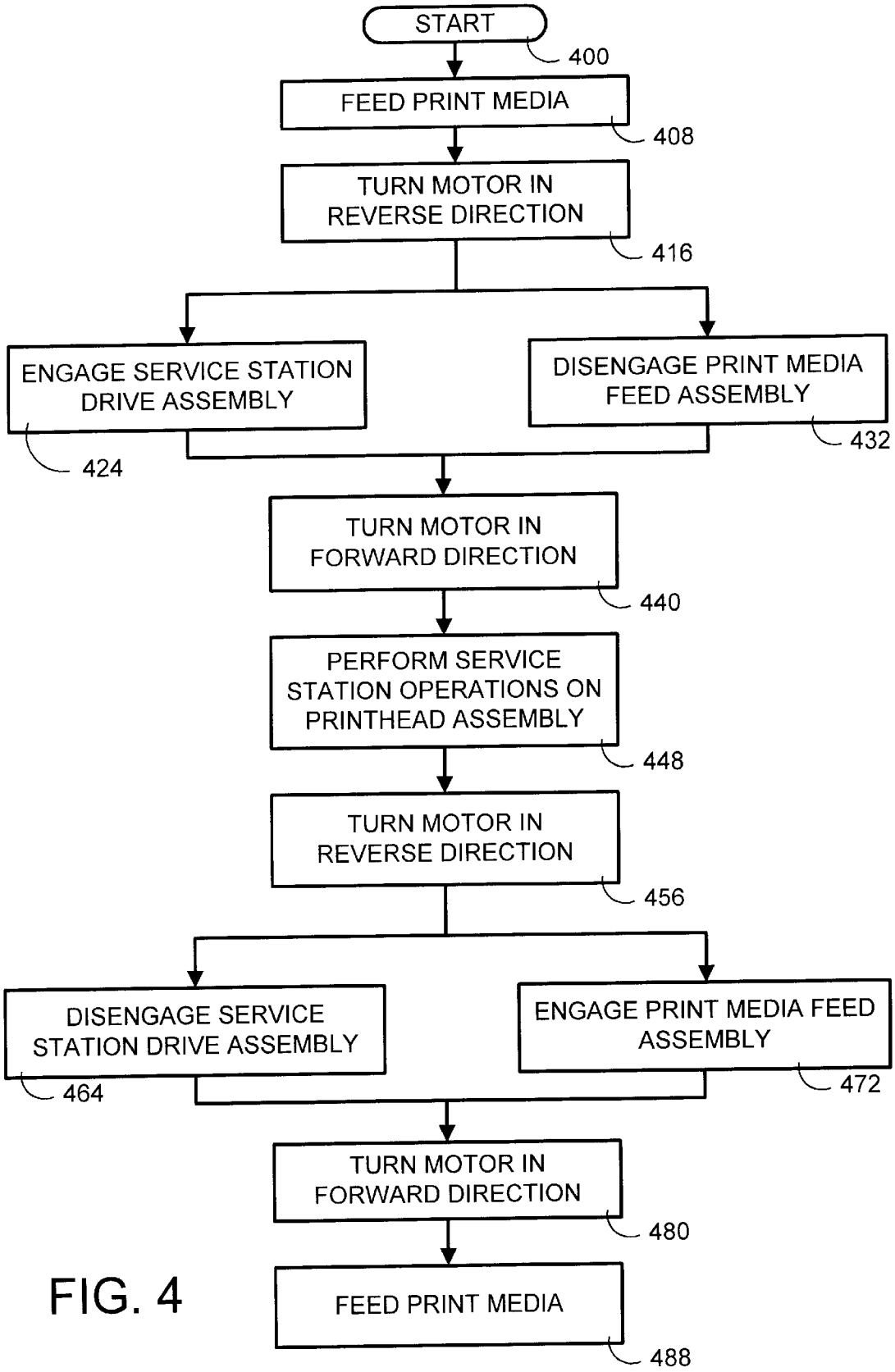
FIG. 4 is a detailed flow diagram illustrating the operation of the present invention.

FIG. 4 is an overview flow diagram of the general operation of the present invention. In general, the cycle of the present invention begins with a print media feed operation, completes that operation and momentarily reverse the motor direction, begins a service station operation, completes that operation and momentarily reverses the motor direction, and begins the cycle again.

The cycle starts (box 400) and the print media is fed by the motor 136 to the printhead assembly 130 (box 408). At this point, the motor 136 is engaged with the print media feed assembly 142 and disengaged from the service station drive assembly 148. As explained in detail below, the motor 136 is then turned momentarily in the reverse direction (box 416) so as to engage the service station drive assembly 148 (box 424) and disengage the print media feed assembly 142 (box 432). In a preferred embodiment, the motor 136 is turned in the reverse direction approximately one-quarter turn. After the engagement of the service station drive assembly 148 and the disengagement of the print media feed assembly 142 the motor 136 is turned in the forward direction (box 440).

Once the service station drive assembly 148 is engaged with the motor 136 service station operations may be performed on the printhead assembly 130 (box 448). These service station operations include, for example, capping, wiping and priming operations. Once the service station assembly 166 has performed the desired servicing of the printhead assembly 130 the motor 136 is momentarily turned in the reverse direction (box 456). This action disengages the service station drive assembly 148 (box 464) and engages the print media feed assembly 142 (box 472). The motor 136 is then turned in the forward direction (box 480) and the print media is feed by the print media feed assembly 142 to the printhead assembly 130 (box 488).

Figure 5:
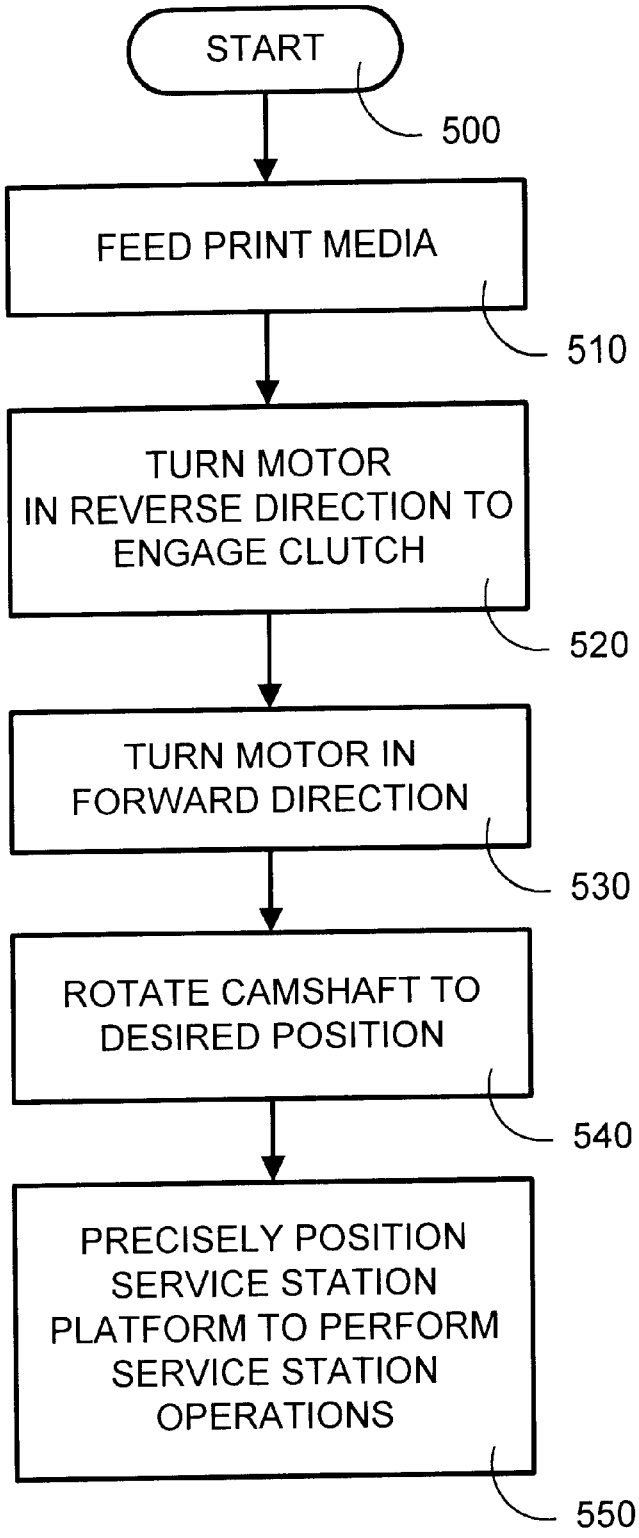
FIG. 5 is a flow diagram illustrating a preferred embodiment for causing the service station drive assembly to engage the motor.

FIG. 5 is a flow diagram illustrating a preferred embodiment for causing the service station drive assembly to engage the motor to perform service station operations. The engagement of the service station starts (box 500) with the print media feed assembly 142 engaged with the motor 136 and feeding print media (box 510) to the printhead assembly 130. The motor 136 is then momentarily turned in the reverse direction and the clutch 325 is engaged (box 520). The clutch 325 is engaged by causing the pin on the "F" assembly 330 to change tracks. In particular, referring also to FIG. 3B, the pin on the "F" assembly 330, which has been riding in the inner track 385 during the print media feed operation, travels from the inner track 385 to the outer track 390 by way of the connecting track 392. This change in tracks is caused by the momentary direction reversal of the motor 136.

Once the clutch 325 has been engaged the motor 136 is then turned in the forward direction (box 530). The motor 136 rotates the camshaft 315 to the desired position (box 540). This desired position includes, for example, a capping position (whereby the capping platforms 355 are elevated to contact the printhead assembly 130) and a wiping position (whereby the wiping platforms 360 are elevated to contact the printhead assembly 130). Using the cams 320,321,322, 323 on the camshaft 315, the platforms on the service station are then precisely positioned to perform service station operations (box 550) on the printhead assembly 130.

Figure 6A:
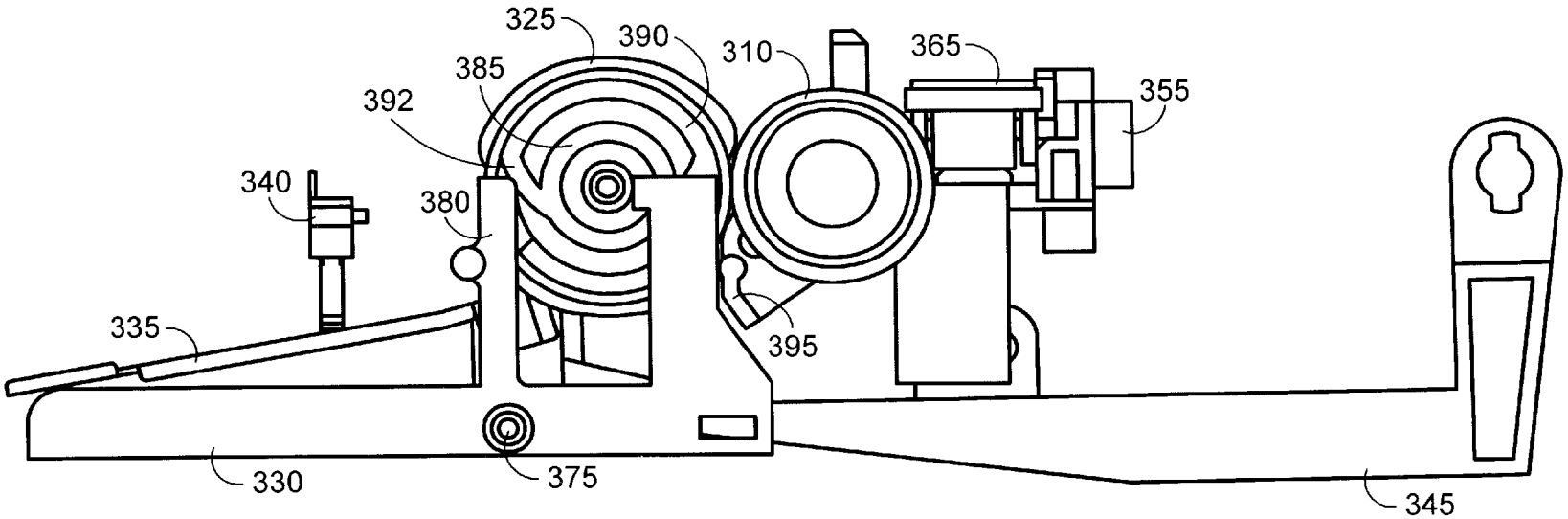
FIG. 6A is an elevation view of a preferred embodiment showing the service station drive assembly in the capping position.

FIG. 6A is an elevation view of a preferred embodiment showing the service station drive assembly in the capping position. In general, the capping platform 355 is at its highest point and capable of placing the cap 365 onto the printhead assembly 130. In the capping position, the pin on the first arm 380 rides in the outer track 390 and the clutch 325 is engaged with the motor 136. As explained in detail below, in the capping position the position sensor 340 is activated by the arm 335 so as to determine the position of the camshaft 315.

Figure 6B:
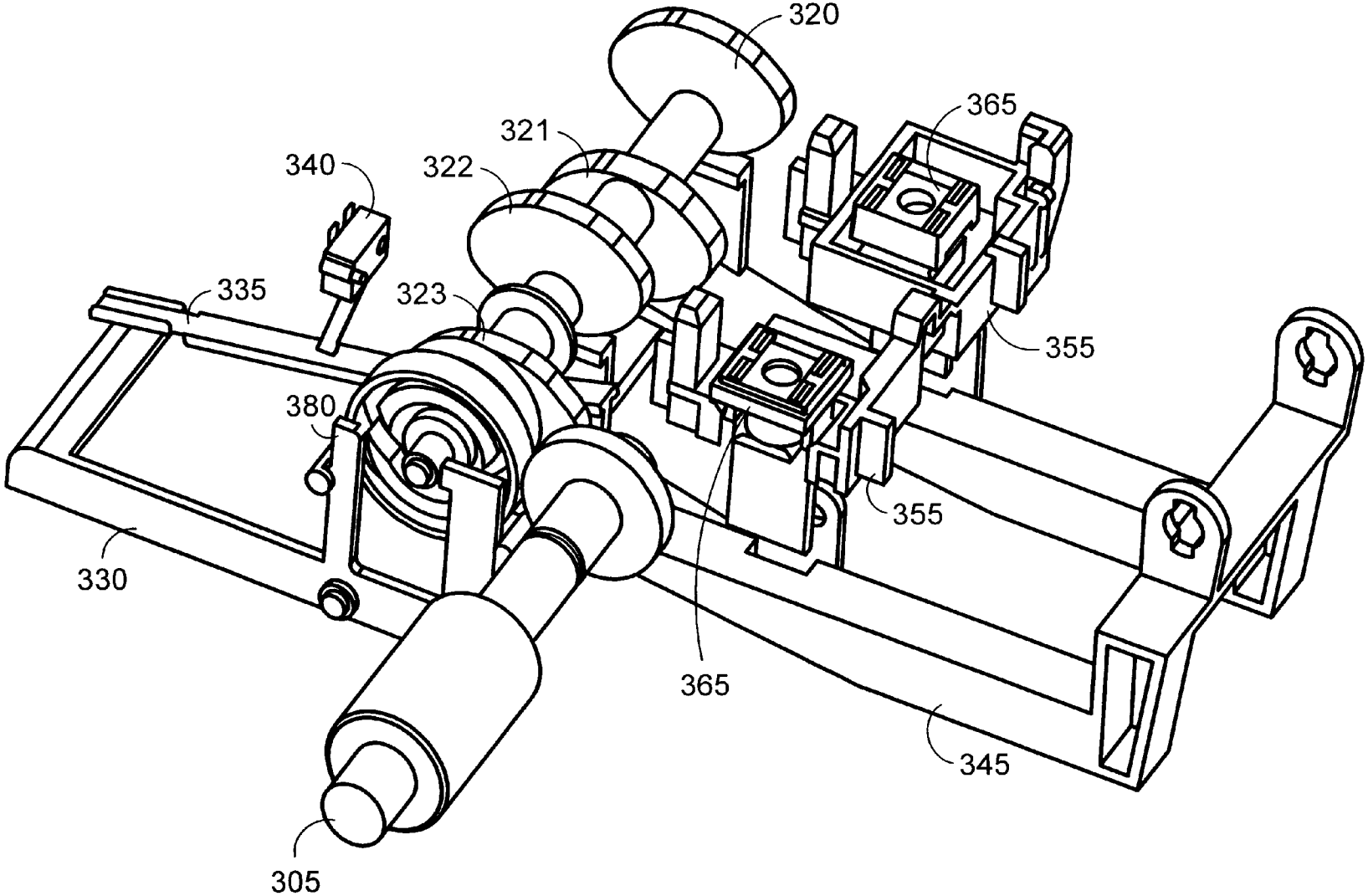
FIG. 6B is a perspective view of the service station drive assembly of FIG. 6A.

Referring to FIG. 6B, which is a perspective view of the service station drive assembly of FIG. 6B, cams 320 and 322 are in a position to allow the capping platforms 355 to reach their full height. In this position the capping platforms 355 are capable of placing the caps 365 on the printhead assembly. Moreover, in the capping position the wiping platforms 360 (not shown in FIG. 6B) are at their lowest height and thus lie below the capping platforms 355.

Figure 7A:
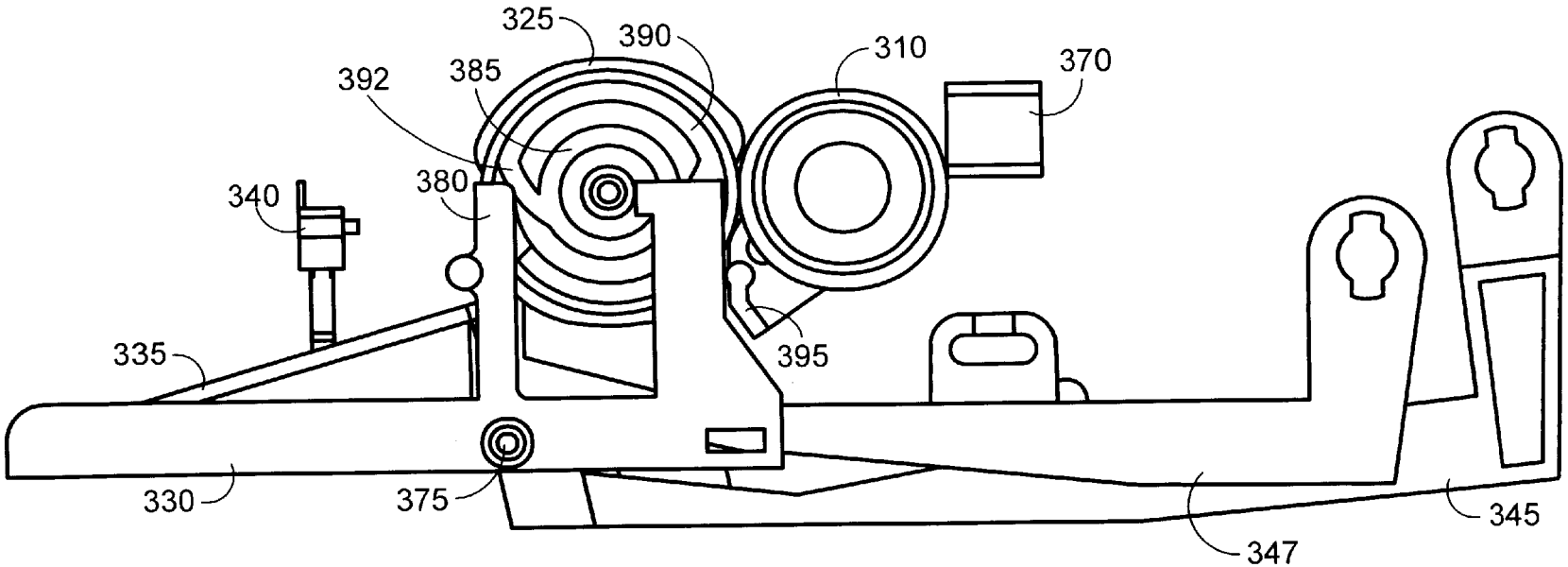
FIG. 7A is an elevation view of a preferred embodiment showing the service station drive assembly in the wiping position.

FIG. 7A is an elevation view of a preferred embodiment showing the service station drive assembly in the wiping position. In this FIG., the wipers 370 are shown floating for better viewing of the underlying parts. It should be noted, however, that the wipers 370 are attached to the wiping platforms 360.

In general, in the wiping position the wipers 370 are at their highest point and capable of wiping the printhead assembly 130. Moreover, in the wiping position the capping platforms 355 are at their lowest position. Thus, the capping platforms 355 and the wiping platforms 360 are not in the same vertical plane and therefore the caps 365 are not as likely to have ink splattered on them by the wipers 370 during wiping operations. As with the capping position, the pin on the first arm 380 rides in the outer track 390 and the clutch is engaged with the motor 136. As explained in detail below, in the wiping position the arm 335 is not in contact with the position sensor 340.

Figure 7B:
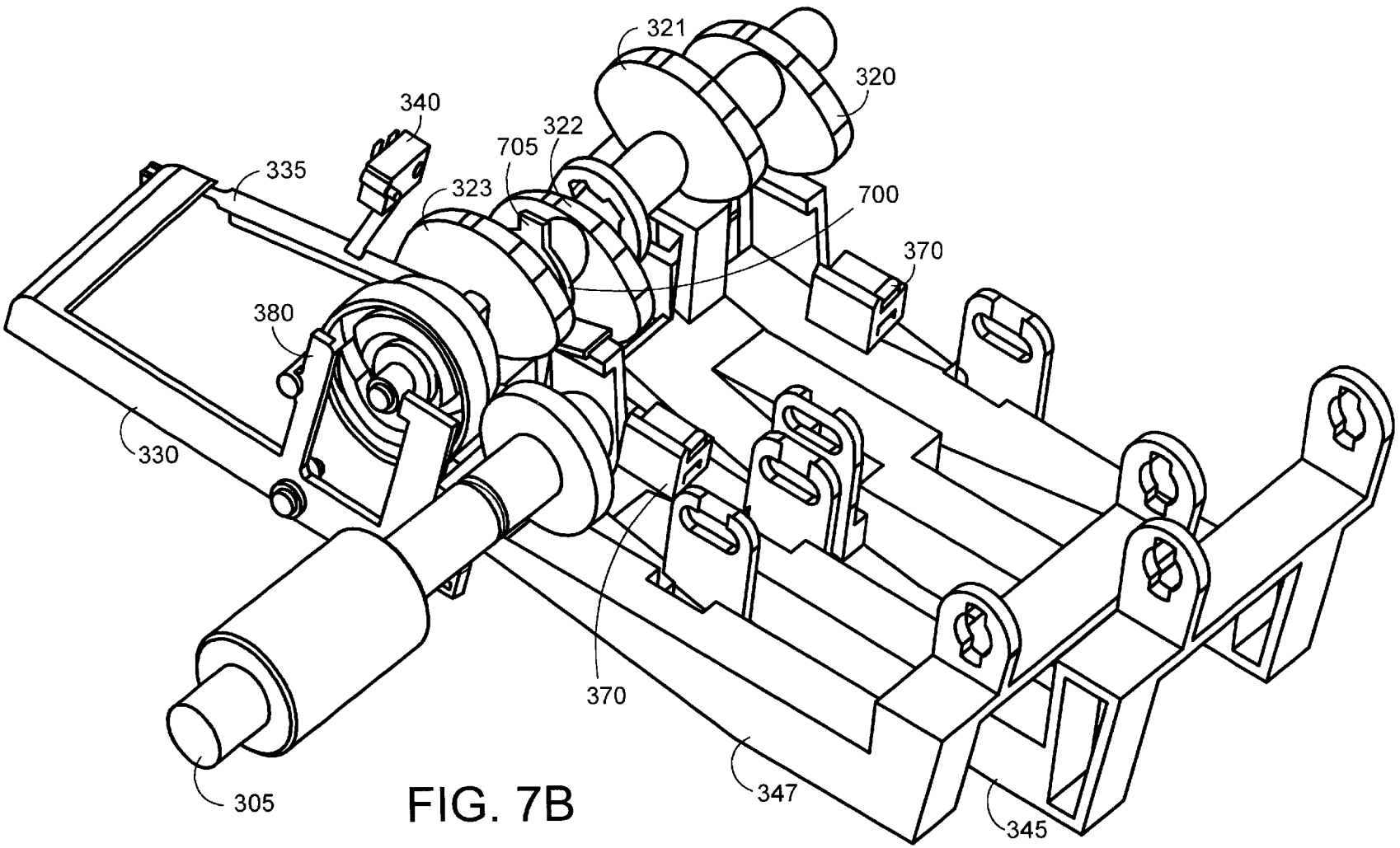
FIG. 7B is a perspective view of the service station drive assembly of FIG. 7A.

FIG. 7B is a perspective view of the service station drive assembly of FIG. 7A. The cams 321 and 323 are in a position to permit the wiping platforms 360 to reach their full height. In this position the wiping platforms 360 are capable of wiping the printhead assembly 130 using the wipers 370.

The camshaft 315 may be precisely positioned using the cams 320, 321, 322, 323 to place the service station assembly 166 in either the capping position or the wiping position. The position of the camshaft 315 is determined using position sensor 340, the arm 335 and a ring 700 having a tab 705. The tab 705 contacts the arm 335 are when the camshaft 315 is in a certain position. When the arm 335 is contacted by the tab 705, the arm 335 is made to activate the position sensor 340, thus determining the position of the camshaft 315. For example, when the service station assembly 166 is in the wiping position as shown in FIG. 7B, the tab 705 is pointed straight up (and not contacting the arm 335) and the arm 335 does not activate the position sensor 340. In the capping position, the tab 705 is pointed straight down (180 degrees from the tab position shown in FIG. 7B) and the tab 705 contacts the arm 335. In turn, one side of the arm 335 is raised, thereby activating the position sensor 340. This cam and position sensor arrangement provides the present invention with precise positioning control of the service station assembly 166.

Figure 8:
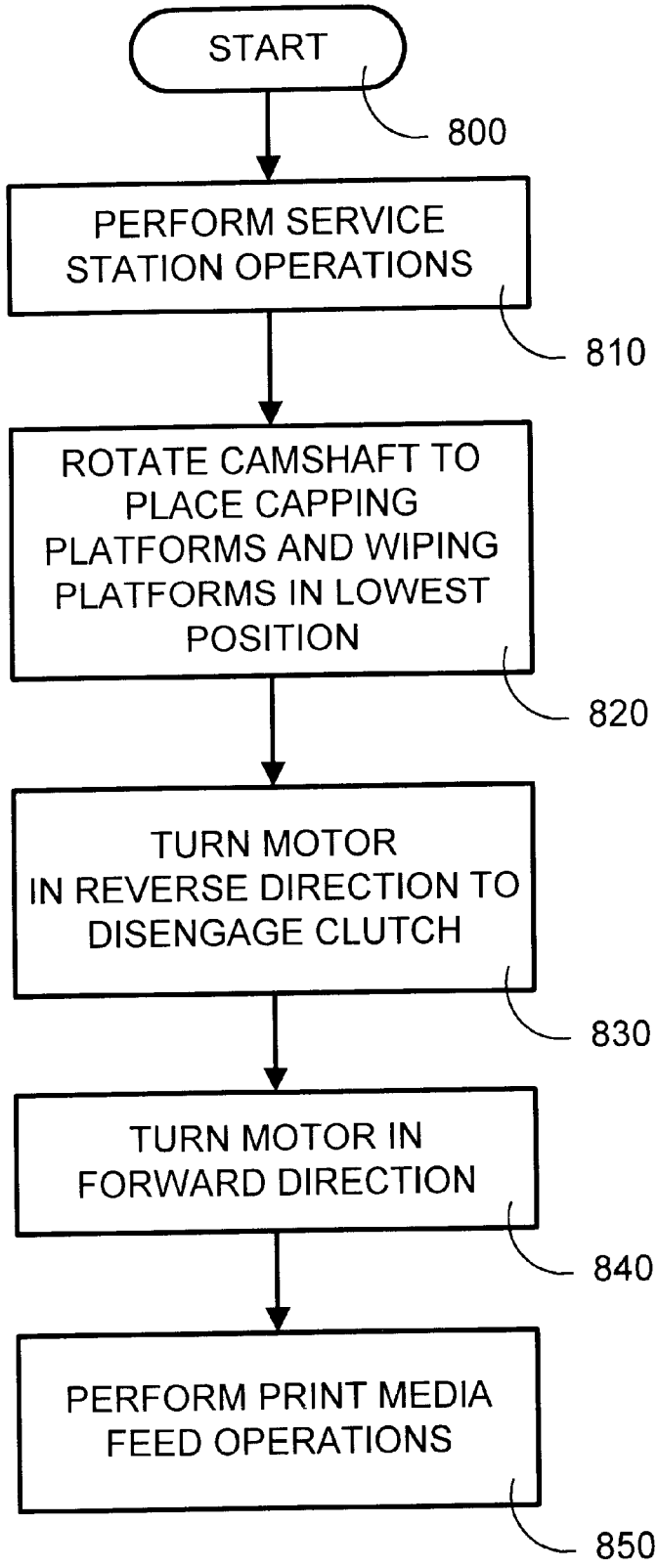
FIG. 8 is a flow diagram illustrating a preferred embodiment for causing the print media feed assembly to engage the motor.

FIG. 8 is a flow diagram illustrating a preferred embodiment for causing the print media feed assembly to engage the motor. The engagement of the print media feed assembly 142 starts (box 800) with the service station drive assembly 300 engaged with the motor 136 and performing service station operations (box 810) such as wiping and capping.

Prior to engaging the print media feed assembly 142, the motor 136 rotates the camshaft 315 so as to lower the wiping platform 355 and the capping platform 360 to their lowest positions (box 820).

The motor 136 is then momentarily turned in the reverse direction so as to disengage the clutch 325 (box 830). This action causes the pin to travel from the outer track 390 to the inner track 385 by way of the connecting track 392 and causes the clutch 325 to disengage from the motor 136. The motor 136 is then turned in the forward direction (box 840) with the print media feed assembly 142 engaged with the motor 136. With the service station drive assembly 300 in this retracted position the print media feed assembly 142 is capable of performing print media feed operations (box 850), such as transporting a piece of paper to the printhead assembly 130.

Figure 9A:
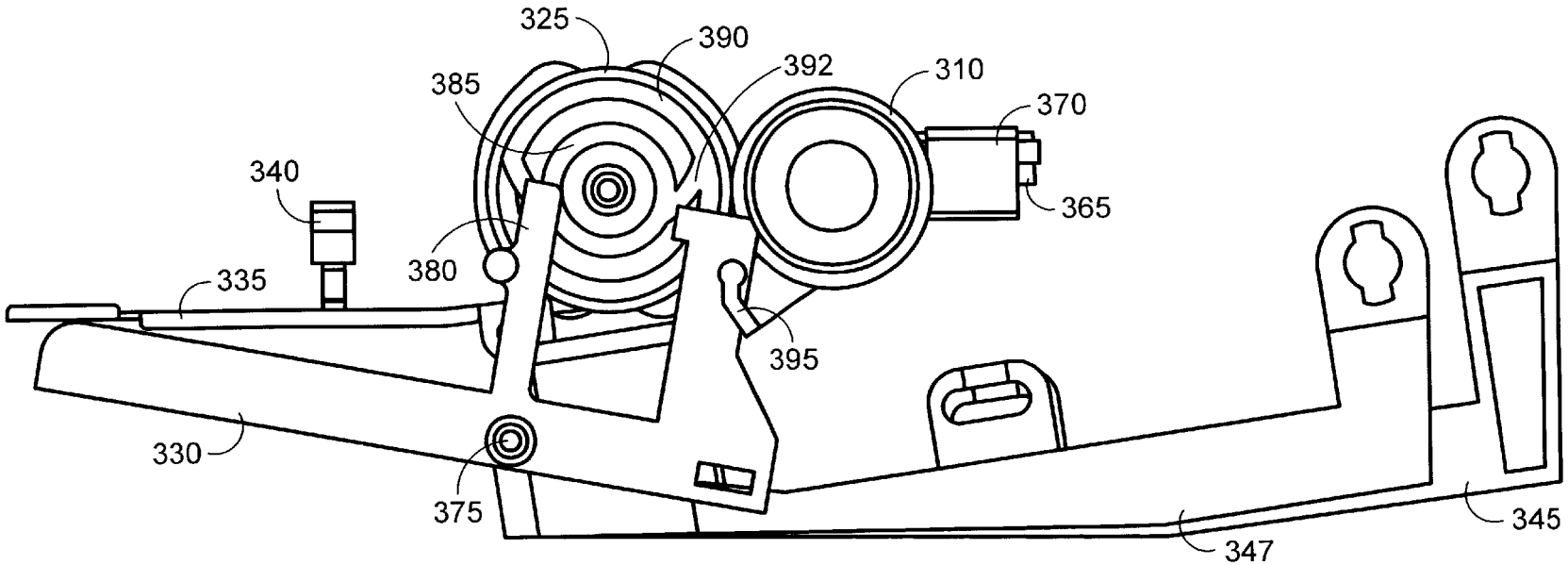
FIG. 9A is an elevation view of a preferred embodiment illustrating the service station drive assembly in the retracted position.

FIG. 9A is an elevation view of a preferred embodiment illustrating the service station drive assembly 300 in the retracted position and disengaged from the motor 136. In this figure, the caps 365 and wipers 370 are shown floating for better viewing of the underlying parts. It should be noted, however, that the caps 365 are attached to the capping platforms 355 and the wipers 370 are attached to the wiping platforms 360.

In general, in the retracted position the caps 365 and wipers 370 are at their lowest point and lie in substantially the same vertical plane. Moreover, the "F" assembly 330 is rotated upward around the pivot point 375 and the pin is riding on the inner track 385 causing the clutch 325 to be disengaged from the motor 136. In this retracted position the service station is not operational and no service station operations may be performed.

Figure 9B:
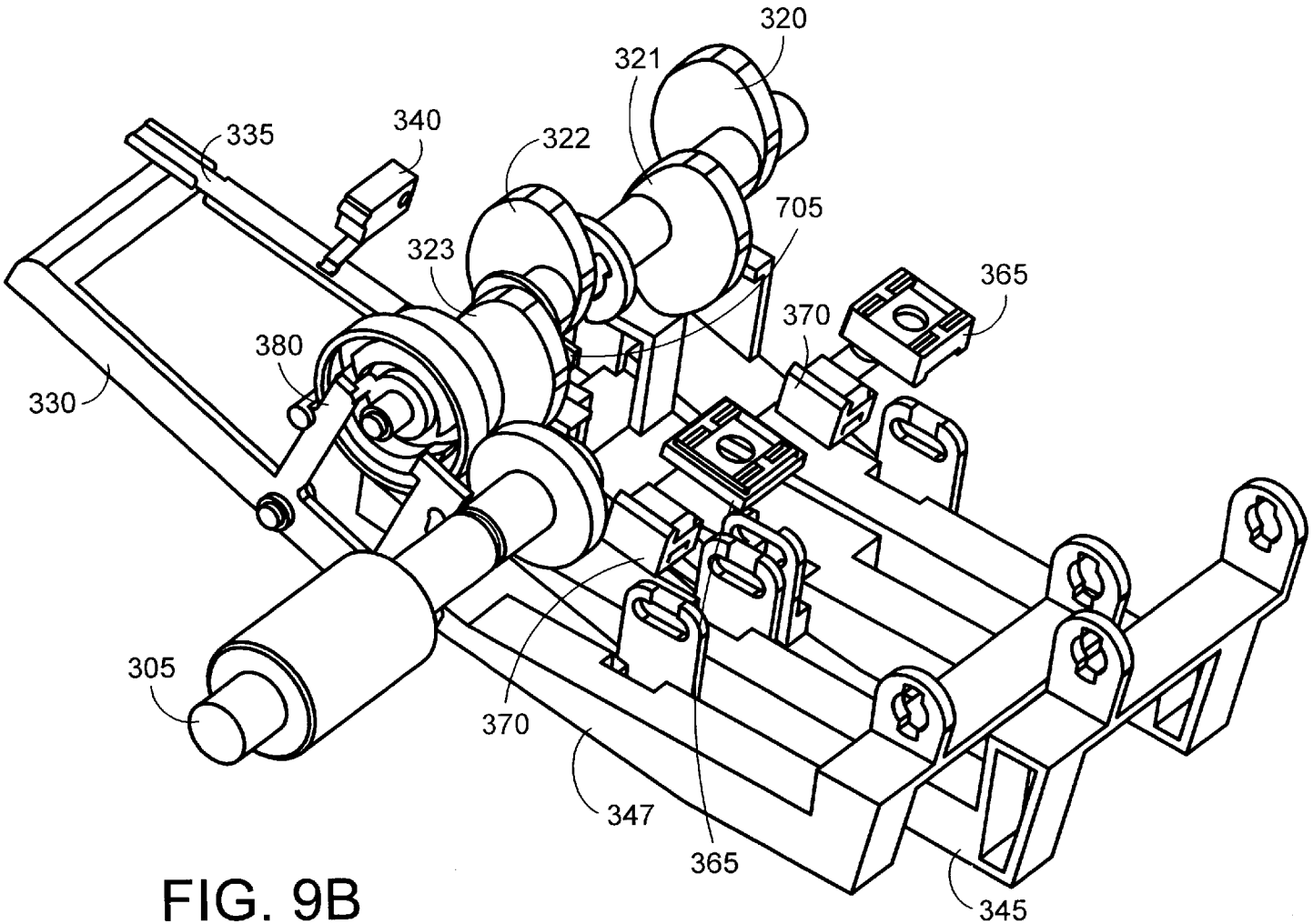
FIG. 9B is a perspective view of the service station drive assembly of FIG. 9A.

FIG. 9B is a perspective view of the service station drive assembly of FIG. 9A. The pin on the first arm 380 is riding in the inner track 385 and each of the cams 320, 321, 322, 323 are in a position so that the caps 365 and the wipers 370 are at their lowest position. With the cams 320, 321, 322, 323 in this position, tab 705 on the camshaft 315 is pointed toward the caps 365 and wipers 370. This placement keeps the caps 365 and wipers 370 out of the way while the print media feed assembly 142 is transporting the print media to the printhead assembly 130.

The foregoing description of the preferred embodiments of the invention has been presented for the purposes of illustration and description. It is not intended to be exhaustive or to limit the invention to the precise form disclosed. Accordingly, the foregoing description should be regarded as illustrative rather than restrictive, and it should be appreciated that variations may be made in the embodiments described by workers skilled in the art without departing from the scope of the present invention as defined by the following claims.

What is claimed is:

1. An ink jet printer having a printhead assembly, comprising:

a single motor that operates a service station drive assembly and a print media feed assembly, wherein the motor is momentarily set in reverse to disengage it from one of the assemblies that it is currently operating and then set forward to engage it to another assembly that it is desired to operate;

a clutch assembly having a pin that rides within each of an inner track and an outer track to selectively operate the print media feed assembly and the service station drive assembly;

a series of rocker arms coupled to the service station drive assembly, each of the series of rocker arms having at least one of the portions of the service station assembly mounted thereon; and a front panel that provides frontal access to the printhead assembly.

2. The ink jet printer of claim 1, further comprising a motor direction controller in communication with the motor and capable of reversing direction of the motor to engage the service station drive assembly and disengage the print media feed assembly and vice versa.

3. The ink jet printer of claim 2, further comprising a rotating assembly in communication with the motor direction controller that rotates around a pivot point to engage one of: (a) the service station drive assembly; (b) the print media feed assembly.

4. The ink jet printer of claim 1, wherein the service station drive assembly further comprises a gear arrangement that moves a first portion of the service station assembly independently of a second portion.

5. The ink jet printer of claim 4, wherein the first portion of the service station assembly is a capping platform and the second portion is a wiping platform.

6. The ink jet printer of claim 4, wherein the gear arrangement is a camshaft having a plurality of cams.

7. The ink jet printer of claim 1, wherein the motor engages one of the service station drive assembly or the print media feed assembly by first momentarily setting the motor in reverse to disengage it from one of the service station drive assembly or the print media feed assembly and second setting the motor forward to engage it to one of the service station drive assembly or the print media feed assembly.

8. A service station assembly for an ink jet printer having a printhead assembly, comprising:

a capping platform;

a wiping platform that does not operate in a same plane as the capping platform and moves independently from the capping platform;

a front panel that provides frontal access to the printhead assembly;

a series of rocker arms each having at least one of the capping platform or the wiping platform mounted thereon, wherein the series of rocker arms move the capping platform and wiping platform independently of each other; and a clutch assembly having a pin that rides within each of an inner track and an outer track that allows a single motor to selectively operate a print media feed assembly and a service station drive assembly and to move the capping platform and the wiping platform independently of each other by first momentarily setting the motor in reverse to disengage it and second setting the motor forward to engage it.

9. The service station assembly of claim 8, wherein a single motor operates the service station drive assembly and a print media feed assembly.

10. The service station assembly of claim 8, wherein the gear arrangement comprises a camshaft having plurality of cams.

11. A method of servicing a printhead assembly of an ink jet printer, comprising:

(a) providing a motor that selectively operates a service station assembly and feeds a print media to the printhead assembly;

(b) engaging one of the following to the motor: (1) a service station drive assembly; (2) a print media feed assembly;

(c) reversing momentarily a direction of the motor to disengage the engaged assembly and engage a disengaged assembly;

(d) providing a series of rocker arms coupled to the service station drive assembly, each of the series of rocker arms having at least a portion of the service station assembly mounted thereon; and (e) selectively operating the print media feed assembly and the service station drive assembly with a clutch assembly that has a pin that rides within each of an inner track and an outer track.

12. The method of claim 11, wherein the motor is reversed for approximately one-quarter revolution.

13. The method of claim 11, wherein the service station drive assembly includes a clutch capable of engaging the motor.

14. The method of claim 13, wherein the reversing of the motor direction causes the clutch to engage the service station drive assembly with the motor.

15. The method of claim 11, wherein the service station drive assembly comprises a gear arrangement coupled to the service station assembly that positions at least a portion of the service station assembly near enough to the printhead assembly to allow the printhead assembly to be capped and wiped.

16. The method of claim 15, wherein the service station assembly comprises a capping platform that caps the printhead and a wiping platform that wipes the printhead.

17. The method of claim 15, wherein the gear arrangement comprises a camshaft that moves a first portion of the service station assembly independently of a second portion of the service station assembly.

18. The method of claim 15, wherein the gear arrangement comprises a position indicator that determines the position of at least a portion of the service station assembly.

19. The method of claim 18, wherein the position indicator comprises a position sensor capable of being actuated by the gear arrangement.

* * * * *